US010518391B2

(12) United States Patent
Dvorscak

(10) Patent No.: US 10,518,391 B2
(45) **Date of Patent: *Dec. 31, 2019**

(54) MAT AND FLOOR COVERING PULLER

(71) Applicant: Peter A. Dvorscak, Nokesville, VA (US)

(72) Inventor: Peter A. Dvorscak, Nokesville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/961,840

(22) Filed: Apr. 24, 2018

(65) Prior Publication Data

US 2019/0015954 A1 Jan. 17, 2019

Related U.S. Application Data

(62) Division of application No. 14/271,448, filed on May 6, 2014, now Pat. No. 9,950,410.

(51) Int. Cl.

| | |
|---|---|
| ***B25B 7/00*** | (2006.01) |
| ***B25B 7/02*** | (2006.01) |
| ***B25B 9/00*** | (2006.01) |

(52) U.S. Cl.

CPC ..... *B25B 7/00* (2013.01); *B25B 7/02* (2013.01); *B25B 9/00* (2013.01)

(58) Field of Classification Search

CPC ..... C03B 35/20; B66C 1/422; B25B 9/02; B25B 9/00; B25B 7/00; B25B 7/02; A47G 21/103; A47G 21/10; B25J 15/0009; B25J 1/00; H01L 21/68707

USPC ..... 294/118

See application file for complete search history.

(56) References Cited

U.S. PATENT DOCUMENTS

| | | | | | |
|---|---|---|---|---|---|
| 1,489,581 | A * | 4/1924 | Lynch | A01K 97/14 | 294/100 |
| 2,429,444 | A * | 10/1947 | Yett | E21B 31/12 | 294/100 |
| 3,208,786 | A * | 9/1965 | Eddleman | A01K 97/14 | 294/115 |
| 5,209,538 | A * | 5/1993 | Gabruel | B66C 1/28 | 294/118 |
| 5,871,242 | A * | 2/1999 | Whitney | B25B 7/00 | 294/104 |
| 5,901,993 | A * | 5/1999 | Lowery | A47J 43/283 | 294/118 |

* cited by examiner

*Primary Examiner* — Stephen A Vu

(74) *Attorney, Agent, or Firm* — William H. Holt

(57) ABSTRACT

A puller including a plurality of pivoted lever members carrying gripper members for securely gripping a mat, pad, carpet or the like for ease in sliding movement and placement thereof. An adjustable handle including a pair of hollow shafts which receive therein slidable shafts each carrying a spring loaded button which can be positioned in a series of openings in the hollow shafts for adjusting the length of the handle so the user can work from a standing position.

8 Claims, 3 Drawing Sheets

MAT AND FLOOR COVERING PULLER

Priority is claimed based upon U.S. Provisional Patent Application 61/855,000, filed on May 6, 2013. The present filing is a division of U.S. application Ser. No. 14/271,448, now U.S. Pat. No. 9,950,410 granted on Apr. 24, 2018.

BACKGROUND OF THE INVENTION

Mats, pads, carpets and other types of floor coverings formed of light to heavy weight materials, for example, fabric, rubber, plastic, plywood and the like have many uses. Examples include tarpaulins for covering baseball fields, yoga mats, Olympic size floor exercise mats, and heavy rubber, or rubber-like, mats for lining the floor of cages in zoos, or the floor in trailers or vans for transporting horses or other large animals, or floors of stables, or pathways in barns for protecting horse's and other animal's hooves from injury caused by cement or other hard surfaces. Rubber mats of this type, in somewhat standard sizes, can vary in thickness between ¼" and ¾" and weigh between 40 and 100 pounds.

SUMMARY OF THE INVENTION

It can be very difficult to move or drag heavy flooring materials, particularly those of large square footage, from one location to another because of the weight and the friction involved. The present invention comprises a puller device and provides an apparatus for securely grasping a mat, or pad, or carpet, or tarpaulin, or plywood, or similar sheet material, to assist a person or persons to pull or drag such articles into, or from, a particular location. One useful process involves removing heavy rubber mats, or pads, from a horse van or horse stall for purposes of periodically cleaning the mat or pad.

DETAILED DESCRIPTION OF THE INVENTION

FIGS. 1-4 show a first embodiment of a puller implement, generally indicated by the numeral 10, which is useful for gripping upon and moving various sheet material in the form of a mat, or pad, or carpet, or tarpaulin, or plywood, or similar sheet material.

Figure 1:
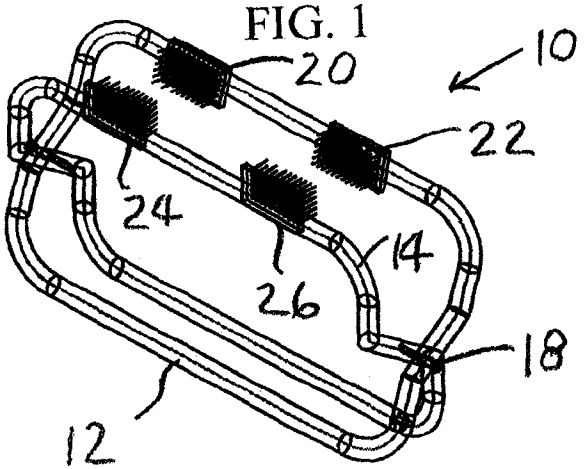
FIG. 1 is a perspective view of a puller comprised of a pair of generally rectangular, inner and outer frames having a plurality of grippers secured thereto for grasping and holding sheet material.
Figure 4:
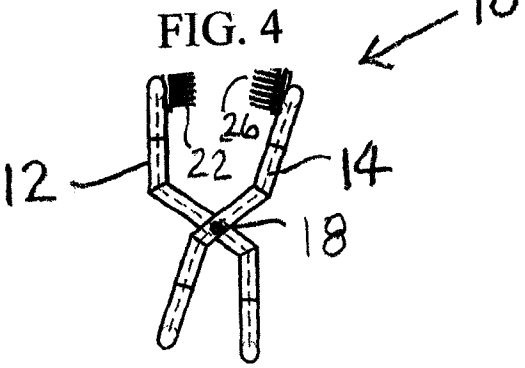
FIG. 4 is a side elevation view of the puller shown in FIG. 1 with the grippers in an open position.
Figure 2:
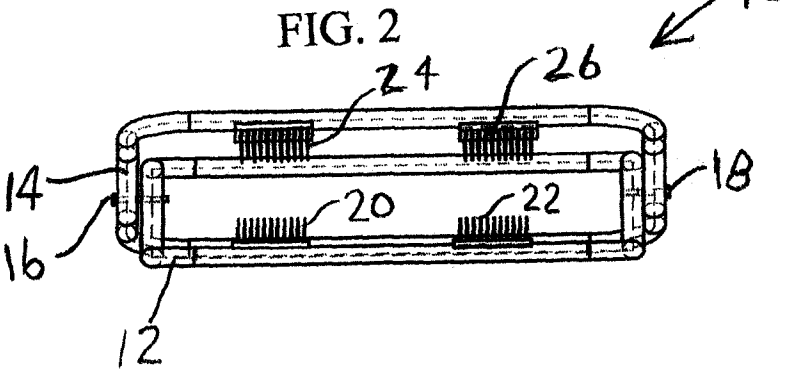
FIG. 2 is a front view of the puller of FIG. 1.
Figure 3:
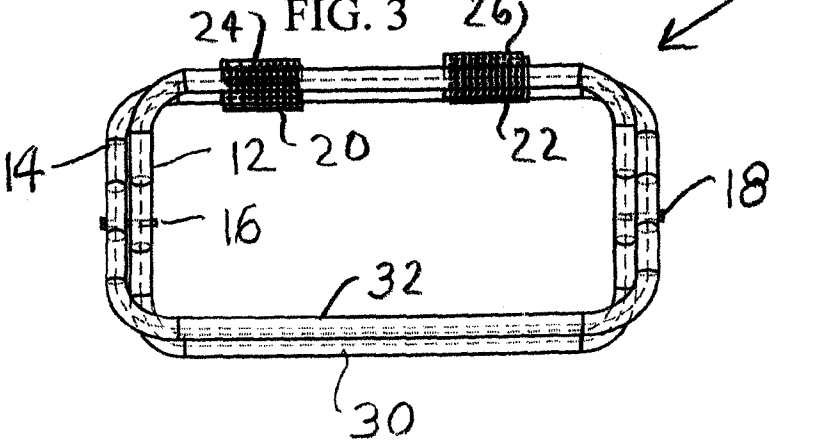
FIG. 3 is a plan view of the puller shown in FIG. 2.
Figure 5:
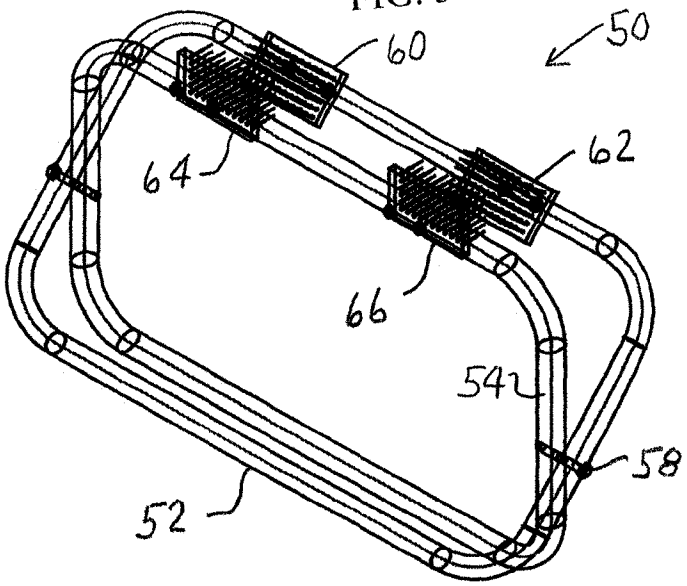
FIG. 5 is a perspective view of a second embodiment of a puller.
Figure 8:
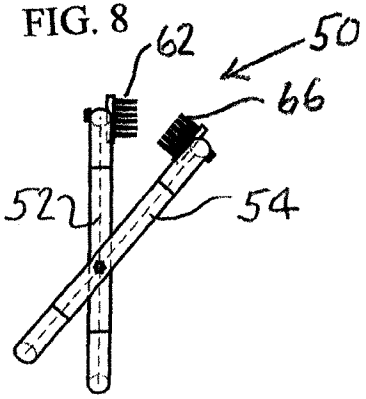
FIG. 8 is a side elevation view of the puller shown in FIG. 5 with the grippers in an open position.
Figure 6:
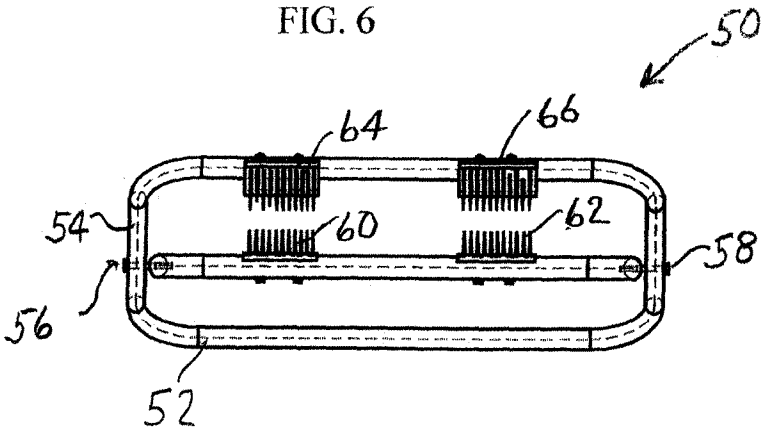
FIG. 6 is a front view of the puller of FIG. 5.

The puller 10 is comprised of a pair of generally rectangular frames 12 and 14. Frame 12 is slightly narrower in width than frame 14 and fits within frame 14, as is best shown in FIG. 3. The frames 12 and 14 are pivotally secured to each other by pivot pins 16 and 18 to provide for relative rotation from an open position to a closed position.

Inner frame 12 includes a pair of grippers in the form of spiked shoes 20 and 22 secured thereto by conventional clamps, screws or bolts which cooperate with similar spiked shoes 24 and 26 which are secured to outer frame 14 in a similar manner. Spiked shoes 20 and 22 are readily detachable from frames 12 and 14 and can be replaced by grippers having different types of gripping surfaces.

Inner frame 12 also includes a handle portion 30 and outer frame 14 includes a handle portion 32. As is best shown in FIG. 3, when handles 30 and 32 are pulled together, the spiked shoes 20 and 22 are closed toward spiked shoes 24 and 26 to grip or grasp a mat, pad, or carper, etc. (not shown) located there between.

FIGS. 5-8 show a second embodiment of a puller implement, generally indicated by the numeral 50, which is useful for gripping and moving various sheet material in the form of a mat, or pad, or carpet, or tarpaulin, or plywood, or similar sheet material.

Figure 7:
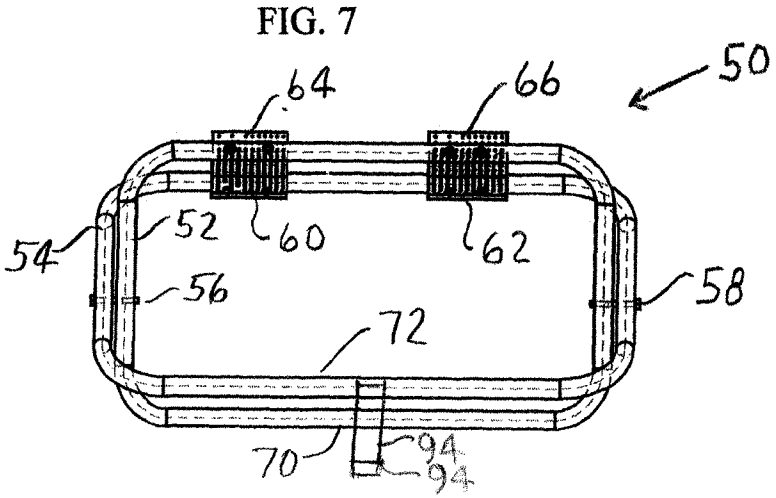
FIG. 7 is a plan view of the puller shown in FIG. 6.

The puller 50 is comprised of a pair of generally rectangular frames 52 and 54. Frame 52 is slightly narrower in width than frame 54 and fits within frame 54, as is best shown in FIG. 7. The frames 52 and 54 are pivotally secured to each other by pivot pins 56 and 58 to provide for relative rotation from an open position to a closed position.

Inner frame 52 includes a pair of grippers in the form of spiked shoes 60 and 62 secured thereto by conventional clamps, screws or bolts which cooperate with similar spiked shoes 64 and 66 which are secured to outer frame 54 in a similar manner. Spiked shoes 60 and 62 are readily detachable in the same manner as shoes 20 and 22 and can be replaced by grippers having different types of gripping surfaces.

Inner frame 52 includes a handle portion 70 and outer frame 54 includes a handle portion 72. As is best shown in FIG. 7, when handles 70 and 72 are pulled together, the spiked shoes 60 and 62 are closed toward spiked shoes 64 and 66 to grip or grasp a mat, pad, or carper, etc. (not shown) located there between.

Comparing FIG. 1 to FIG. 5, and comparing FIG. 4 to FIG. 8 the differences between puller 10 and puller 50 will be seen wherein the side portions of frames 12 and 14 include a bent portion while the side portions of frames 52 and 54 are straight.

The frames 12, 14, 52 and 54 are shown as being comprised of metal tubes preferably formed of aluminum to minimize the weight. It is to be understood however that the frames may be comprised of other materials such as wood or plastic with sufficient strength for pulling on the mats, or pads, etc., and can be formed of bar stock, or flat material, etc.

As mentioned above, it is contemplated that the pullers 10 and 50 are to be used in pulling a mat, or pad, or carpet, or tarpaulin, or plywood, or similar sheet materials. The weight of these sheet materials will, of course, vary depending upon the material and size, i.e., the area and thickness. For example, a rubber mat to be used in horse vans, or stalls, or walkways can vary from about ¼ inch to about ¾ inch, or more, and may be on the order of 10 feet by 15 feet and weigh on the order of 40 to 100 pounds.

As is shown in FIGS. 3 and 7, the frames 12 and 14, and frames 52 and 54 are wider than their depth. It is within the scope of the invention that the distance between the handles 30 and 32 and spiked shoes or grippers 20, 22, 24 and 26, and the distance between the handles 70 and 72, and the spiked shoes or grippers 60, 62, 64 and 66 can be increased to about three feet so that the puller implements 10 and 50 can to used to grip a floor covering, mat, etc., without the need for the user to bend down toward the ground or floor. In addition, it is within the scope of the invention that the grippers or spiked shoes 20 or 60, etc., particularly the ones adjacent the floor or ground, be provided with a thin leading edge, or thin ramp, for assisting easy insertion of the lower grippers or spiked shoes underneath the floor covering or mat without requiring the user to bend down, and without requiring manual handling of the contaminated floor covering or mat.

It is also to be understood that the frames 12 and 14, and 52 and 54 can be comprised of a plurality of parts that are secured together by different processes such as by welding, or be secured by threaded members and fasteners.

Figure 9:
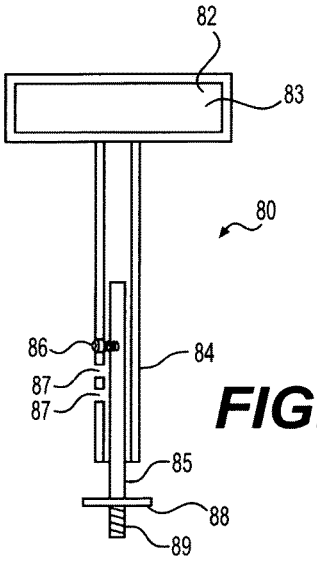
FIG. 9 is an elevation view of an adjustable handle that can be detachably secured to the pullers shown in FIGS. 1-8

FIG. 9 discloses an adjustable handle, generally indicated by the numeral 80, and includes a hand grip portion 82 which is, preferably, wide enough to be gripped by two hands of a person using the device, approximately six inches wide and having an open space 83 of about three inches deep.

Handle 80 is comprised of a pair of hollow shafts 84 which receive therein slidable shafts 85 each which carries a spring loaded button 86 which can be positioned in a series of openings 87 for adjusting the length of handle 80, preferable up to about four feet in length so that the user can work from a standing position. Shaft 85 can be provided with a removable pin 88 and/or a threaded end 89 for fixedly connecting handle 80 to socket members secured to frames 12 and 14, and frames 70 and 72.

Figure 10:
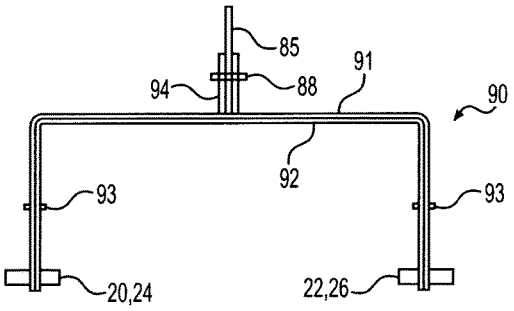
FIG. 10 is an elevation view of a third embodiment of a puller in closed condition.

FIG. 10 is a modified form of a frame member 90 comprised of a pair of U-shaped members 91 and 92 which are pivotally connected together by a pair of pins 93. Each of a pair of shafts 85, of handles 80, are secured in tubular socket members 94 on the respective U-shaped members 91 and 92 by removable pins 88. Free end portions of U-shaped members 91 and 93 are each provided with a pair of matching gripper members 20, 22 and 24, 26. When the hand grip portions 82, of the pair of handles 80 are brought together, gripper member 20, 22 and 24, 26 make a secure purchase upon a mat, pad, carpet or tarpaulin disposed between the gripper members.

Figure 11:
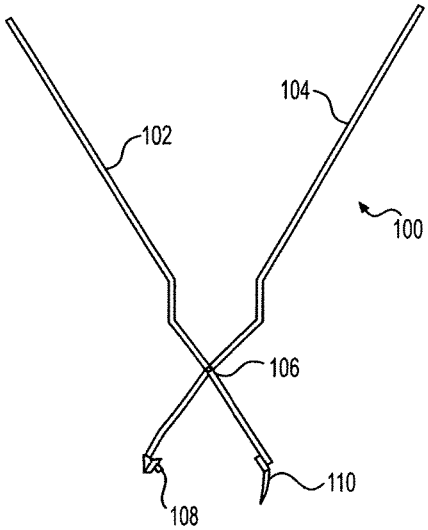
FIG. 11 is an elevation view of a fourth embodiment of a puller shown in open position.

FIG. 11 shows a further embodiment of a puller, generally indicated by the numeral 100, and comprised of a pair of handles 102 and 104 pivoted together at 106. The free ends of handles 102 and 104 may be secured in sockets 94 for carrying a frame member 90, as in FIG. 10, or may each have a gripper member 108, similar to grippers 20 and 22 secured thereto. In addition, a thin slider or tong 110 is secured to handle 102, or directly to a gripper member 108, or likewise to the frame members in FIGS. 1-10, for sliding under a mat, pad or carpet, etc., to be readily slid into position between the respective gripper members carried by the various handles and frame members.

The disclosed embodiments and variations thereof are considered to be examples of devices in accord with the invention as defined by the appended claimed subject matter.

The invention claimed is:

1. A puller for gripping a mat, pad, or carpet or the like for aiding in the movement and placement thereof;

said puller including a pair of pivoted lever members and a plurality of gripping members mounted on said lever members;

each said pivoted lever member having a gripper member secured thereto that cooperates with another gripper member carried by and secured to an adjacent pivoted lever member;

each of said gripper members having gripping surfaces thereon for securely gripping said mat, pad, or carpet;

said puller being provided with an adjustable length handle, said adjustable length handle including a hand grip portion wide enough to be gripped by two hands of a person using said puller, said adjustable length handle including a pair of hollow shafts, said hollow shafts receiving therein slidable shafts each carrying a spring loaded button selectively positional in a series of openings in said hollow shafts for adjusting the length of said adjustable length handle.

2. A puller as defined in claim 1, wherein each said gripper member includes a plurality of spikes for penetrating a surface of said mat, pad, or carpet for providing a secure purchase thereof.

3. A puller as defined in claim 2, wherein said lever members are comprised of a pair of elongated handles for allowing a user to operate in a standing position, said pair of elongated handles being pivoted to each other for moving said gripper members toward and away from each other.

4. A puller as defined in claim 1, including a slider secured to at least one of said pivoted lever members for sliding under said mat, pad, or carpet for promoting ease in sliding said puller into position for gripping said mat, pad, or carpet.

5. A puller as defined in claim 1, including a pair of U-shaped members pivoted together, each of said U-shaped members having a tubular socket member secured thereto for receiving free ends of said hollow shafts for attaching said hollow shafts to said U-shaped members, said U-shaped members having spaced free end portions each having at least one of said gripper members thereon for making a secure purchase of said mat, pad, carpet.

6. A puller as defined in claim 5, wherein each said gripper member includes a plurality of spikes for penetrating a surface of said mat, pad, or carpet for providing a secure purchase thereof.

7. A puller as defined in claim 6, wherein said lever members are comprised of a pair of elongated handles for allowing a user to operate in a standing position, said pair of elongated handles being pivoted to each other for moving said gripper members toward and away from each other.

8. A puller as defined in claim 5, including a slider secured to at least one of said pivoted lever members for sliding under said mat, pad, or carpet for promoting ease in sliding said puller into position for gripping said mat, pad or carpet.

* * * * *